US006305988B1

(12) United States Patent
Arakawa et al.

(10) Patent No.: US 6,305,988 B1
(45) Date of Patent: Oct. 23, 2001

(54) CRT SOCKET

(75) Inventors: Hiroharu Arakawa; Atsushi Arai, both of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/491,745

(22) Filed: Jan. 27, 2000

(30) Foreign Application Priority Data

Feb. 10, 1999 (JP) ..... 11-032802

(51) Int. Cl.[7] ..... H01R 33/76
(52) U.S. Cl. ..... 439/683
(58) Field of Search ..... 439/683, 182

(56) References Cited

U.S. PATENT DOCUMENTS 2,874,342 * 2/1959 Del Camp ..... 439/182
3,683,228 * 8/1972 Kleen ..... 439/683
6,019,642 * 2/2000 Nagata ..... 439/683

* cited by examiner

*Primary Examiner*—Brian Sircus
*Assistant Examiner*—Phuong KT Dinh
(74) *Attorney, Agent, or Firm*—Morrison Law Firm

(57) ABSTRACT

A cathode ray tube (CRT) socket provides for improved performance by increasing the creeping distance between high and low voltages associated with a correspondingly connected CRT. The CRT socket includes a socket body with a cylindrical central hole extending through its front and rear faces, signal connecting means arranged on a concentric circle about the cylindrical central hole, the signal connecting means engaging with signal terminals from the CRT, and an insulating cover portion arranged on the same concentric circle as the signal connecting means, the insulating cover portion having a high voltage connecting means for engaging with a focusing terminal of the CRT. The signal connecting means is constructed by forming a recessed signal contact portion in the front face of the socket. A plurality of signal contact holes are formed in the recessed signal contact portion of the front face. Each of the plurality of signal contact holes are spaced apart at a predetermined interval. The high voltage connecting means includes a recessed high voltage contact portion which is formed by recessing a front face portion of the socket and a high voltage contact hole formed on the recessed face. The holes formed in the recessed portions of the high voltage connecting means and the signal connecting means engage the terminals on the neck of the CRT. The recessed signal contact portion and the recessed high voltage contact portion are separated from each other by a groove portion which extends to the front and rear faces of the socket body. Creeping distance is increased by separating the high and low voltage (signal) portions of the socket by the groove portion.

25 Claims, 7 Drawing Sheets

PRIOR ART

PRIOR ART

PRIOR ART

CRT SOCKET

BACKGROUND OF THE INVENTION

The present invention relates to a cathode ray tube (hereinafter simply referred to as a "CRT") socket. More particularly, the present invention relates to a CRT socket that includes a structure in which a creeping distance is secured by recessing an engaging portion in the socket. The engaging portion of the CRT socket engages a high voltage contact terminal which couples the CRT focus voltage to the CRT. According to the present invention, creeping distance is increased and the CRT socket height is reduced.

DESCRIPTION OF THE BACKGROUND ART

Conventional CRTs are controlled by a combination of high and low voltages. For example, the focus voltage on a conventional CRT typically receives potentials on the order of 10,000 volts from a flyback transformer, while a video signal is normally on the order of 100 volts. Because of the large differences in potential, a high voltage circuit section perceives potentials in a video signal section to be approximately at the same potential level as ground. If current were to flow from the high voltage section through the signal section, electronic components and circuits in the signal section (i.e. semiconductor devices) are likely to be destroyed. Therefore, the high voltage section and the signal sections in conventional CRTs must be insulated from one another to prevent a high voltage discharge. Creeping distance is required to prevent this destructive high voltage discharge from occurring.

According to the prior art, CRT sockets are available in a variety of shapes. One example of a CRT socket (hereinafter simply referred to as a "socket") is disclosed in Japanese Laid-Open (Kokai) Utility Model No. 59-173289 which is entitled "a socket for a cathode ray tube". As shown in FIGS. 8 and 9, a socket consists of socket body 10 and insulating cover portion 11.

Socket body 10 has a generally cylindrical shape. A cylindrical central hole 12 is located in a central portion of socket body 10. Cylindrical central hole 12 extends through the socket body, from a front to a rear face. A high voltage contact portion 13 and a signal contact portion 14 are arranged on a concentric circle formed along a circumference of cylindrical central hole 12. High voltage contact portion 13 is spaced apart from signal contact portion 14. A high voltage contact 15 is located in a substantially central position of high voltage contact portion 13 from a rear side of socket body 10.

Signal contact portion 14 includes a signal contact 16 and a ground terminal 17. A CRT signal is communicated to the CRT through signal contact 16 via a terminal (not shown). Ground terminal 17 discharges high voltages which are generated in signal contact 16. Signal contact 16 includes a connecting terminal 18 which is formed in a sleeved shape and a lead wire connecting terminal 19. Lead wire connecting terminal 19 is formed with a bent portion oriented perpendicular to socket body 10 in an outward direction. Connecting terminal 18 engages with a terminal (not shown) which couples a signal to a neck of the CRT on an end tip side of signal contact 16. Ground terminal 17 includes a spherical cap 20 for discharging high voltages. Spherical cap 20 is positioned opposite to an intermediate position of lead terminal 19 of signal contact 16.

A second example of a prior art CRT socket is shown in FIG. 10. The second example has approximately the same structure as the first example discussed above. Similar to the first example, signal contact portion 14 is formed in a circumferential shape concentric with cylindrical central hole 12 which extends through socket body 10 to its front and rear faces. The second example differs from the first example in that a ground terminal 17A, used for discharging high voltage, is stored and arranged within socket body 10. Namely, signal contact portion 14 includes a signal contact 16 and a ground terminal 17A. An end portion 21 is formed on a side which is opposite to an engaged end portion of ground terminal 17A. A discharge gap is formed between signal contact 16 and a bent end portion 21 of ground terminal.

A third example of a prior art CRT socket is disclosed in Japanese Laid-Open (Kokai) Patent No. 2-49091 which is entitled "a cathode ray tube socket". As shown in FIGS. 11 and 12, this example has a structure in which a creeping distance is increased by forming a groove between a high voltage contact 15 and a signal contact 16. This structure includes a socket body 10A which is formed in a cylindrical shape and an insulating cover portion 11A which is formed in a square shape. Insulating cover portion 11A covers socket body 10A. A cylindrical central hole 12A extends through front and rear faces of socket body 10A. A high voltage contact portion 13A and a signal contact portion 14A are formed in a circumferential shape positioned about cylindrical central hole 12A. The high voltage contact portion 13A is separated by groove portions 22 and 23. Groove portions 22 and 23 extend through front and rear faces of socket body 10A. The groove portions are positioned between high voltage contact portion 13A and signal contact portion 14A. A high voltage contact hole 24 stores high voltage contact 15 therein. A barrier fitting groove 25 separates high voltage contact 15 from high voltage contact portion 13A by a predetermined gap. The barrier fitting groove 25 extends along a commonly connected bottom portion of high voltage contact hole 24.

A fourth example of a prior art CRT socket is shown in FIG. 13. This fourth example is structurally similar to the third example discussed above. In this example, a groove portion 22A extends through front and rear faces of a socket body 10B. Groove portion 22A is arranged between a high voltage contact portion 13B and a low voltage contact portion 26. High voltage contacts 15 are located within high voltage contact holes 24. A low voltage contact 29 is located with a low voltage contact hole 28. Groove portion 22A separates high voltage contacts 15 from each other. A rib 27 is located in groove portion 22A in socket body 10B at an intermediate position. When the socket body 10B is covered with an insulating cover portion 11B, rib 27 is inserted in the intermediate position of the groove portion 22A. Accordingly, it is possible to increase the creeping distance between the high voltage contact 15 and a low voltage contact 29.

PROBLEMS IDENTIFIED WITH THE PRIOR ART

The CRT sockets shown in each of the preceding examples have structures in which a discharge gap is obtained by setting a ground terminal in a physical position opposite to an intermediate terminal of the signal contact. The ground terminal serves to discharge the signal contact. The above discussed structures do not practicably permit the height of the CRT socket body to be reduced.

Furthermore, creeping distance in the above discussed conventional CRT sockets are insufficient in preventing high voltage discharge phenomenon from occurring. The structures found in prior art CRT sockets tend to result in a discharge state where an end tip side and a high voltage connector tend to short together.

In recent years, there has been a significant increase in the focus voltage for CRTs used in color television units. The increase in focus voltage is predominately due to the need to improve image quality by reducing the aberrations from the electron lens as well as the increasing sizes of conventional television screens. The use of higher focus voltages requires additional care to be taken to prevent the above discussed problems from occurring.

Accordingly, problems exist in that the height of the CRT socket itself cannot be practicably reduced. An improved socket structure is needed in which the position of the ground terminal for discharge is arranged relative to the signal contact and the creeping distance to prevent the discharge state from the high voltage contact.

OBJECTS AND SUMMARY OF THE INVENTION

It is an object of the present invention to provide a jack-type connector which overcomes the drawbacks and limitations of the prior art.

To solve the above problems, a CRT socket in the present invention comprises a socket body having a cylindrical central hole extending through the socket body to its front and rear faces, and signal connecting means which is arranged on the same outside concentric circle as the cylindrical central hole and can be engaged with a terminal for a signal of a CRT; and an insulating cover portion arranged on the same concentric circle as said signal connecting means and having high voltage connecting means capable to be engaged with a terminal for focusing of the CRT; said signal connecting means being constructed by a signal contact recessed portion having a recessed face formed by recessing a top face portion engaged with said CRT, and plural signal contact holes formed on the recessed face at a predetermined interval; and said high voltage connecting means being constructed by a high voltage contact recessed portion having a recessed face formed by recessing a top face portion engaged with said CRT, and a high voltage contact hole formed on this recessed face so that said signal contact recessed portion and the high voltage contact recessed portion are separated from each other by a groove portion extending to the front and rear faces.

Further, a signal contact coming in contact with the terminal for a signal of the CRT is arranged in each of said signal contact holes in a state in which one portion of a contact terminal coming in contact with said terminal for a signal is exposed within each of said signal contact holes, and a ground terminal for removing discharged electricity is arranged in an opposite state to a position behind the exposed and arranged contact terminal.

In such a structure for recessing the top face portion having the contact hole and forming the contact hole in this recessed portion, a peripheral portion of the recessed portion is set to a wall so that a creeping distance of a high voltage caused by discharge, etc. from the exterior can be increased.

Further, the height of the socket itself can be reduced by providing a structure in which the ground terminal for discharging electricity is arranged in an opposite position behind a contact terminal portion of the signal contact coming in contact with a terminal of a neck of the CRT inserted from the exterior.

Briefly stated, the present invention provides for a cathode ray tube (CRT) socket with improved performance by increasing the creeping distance between high and low voltages associated with a correspondingly connected CRT. The CRT socket includes a socket body with a cylindrical central hole extending through its front and rear faces, signal connecting means arranged on a concentric circle about the cylindrical central hole, the signal connecting means engaging with signal terminals from the CRT, and an insulating cover portion arranged on the same concentric circle as the signal connecting means, the insulating cover portion having a high voltage connecting means for engaging with a focusing terminal of the CRT. The signal connecting means is constructed by forming a recessed signal contact portion in the front face of the socket. A plurality of signal contact holes are formed in the recessed signal contact portion of the front face. Each of the plurality of signal contact holes are spaced apart at a predetermined interval. The high voltage connecting means includes a recessed high voltage contact portion which is formed by recessing a front face portion of the socket and a high voltage contact hole formed on the recessed face. The holes formed in the recessed portions of the high voltage connecting means and the signal connecting means engage the terminals on the neck of the CRT. The recessed signal contact portion and the recessed high voltage contact portion are separated from each other by a groove portion which extends to the front and rear faces of the socket body. Creeping distance is increased by separating the high and low voltage (signal) portions of the socket by the groove portion.

According to an embodiment of the invention, there is provided for a socket for a cathode ray tube, the cathode ray tube having a plurality of signal terminals and a focus terminal, the socket comprising: a socket body having a cylindrical central hole, a front face and a rear face on opposing sides of the socket body, the cylindrical central hole extending through the socket body from the front face to the rear face, an insulating cover portion is arranged on a concentric circle about the cylindrical central hole, a signal connecting means for engaging the plurality of signal terminals of the cathode ray tube, a high voltage connecting means for engaging the focus terminal of the cathode ray tube, the high voltage connecting means and the signal connecting means engaging the cathode ray tube, the signal connecting means including a signal contact recessed portion and a plurality of signal contact holes, the signal contact recessed portion is formed in the front face along a concentric circle about the cylindrical hole, a plurality of signal contact holes are uniformly dispersed at predetermined intervals along the signal contact recessed portion, the high voltage connecting means having a high voltage contact recessed portion and a high voltage contact hole, the high voltage contact recessed portion is formed in the front face along the concentric circle about the cylindrical hole, the high voltage contact hole is formed in the high voltage contact recessed portion of the high voltage connecting means, a groove portion separating the signal contact recessed portion from the high voltage contact recessed portion, and the groove portion extending through the socket body from the front face to the rear face.

According to another embodiment of the invention, there is provided for a socket for a cathode ray tube, the cathode ray tube having a plurality of signal terminals, a high voltage focus terminal and a low voltage focus terminal, the socket comprising: a socket body having a cylindrical central hole, a front face and a rear face on opposing sides of the socket body, the cylindrical central hole extending through the socket body from the front face to the rear face, an insulating cover portion is arranged on a concentric circle about the cylindrical central hole, a signal connecting means for engaging the plurality of signal terminals of the cathode ray tube, a high voltage connecting means for engaging the high voltage focus terminal of the cathode ray tube, the high voltage connecting means and the signal connecting means engaging the cathode ray tube, the signal connecting means having a signal contact recessed portion and a plurality of signal contact holes, the signal contact recessed portion is formed in the front face along a concentric circle about the cylindrical hole, a plurality of signal contact holes are uniformly dispersed at predetermined intervals along the signal contact recessed portion, the high voltage connecting means having a high voltage contact recessed portion and a high voltage contact hole, the high voltage contact recessed portion is formed in the front face along the concentric circle about the cylindrical hole, the high voltage contact hole is formed in the high voltage contact recessed portion of the high voltage connecting means, a first groove portion separating the signal contact recessed portion from the high voltage contact recessed portion, the first groove portion extending through the socket body from the front face to the rear face, the signal connecting means including a first partition, the first partition is located at an edge of the signal contact recessed portion adjacent the first groove portion, and the first partition is effective to increase a creeping distance between the high voltage connecting means and the signal connecting means.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
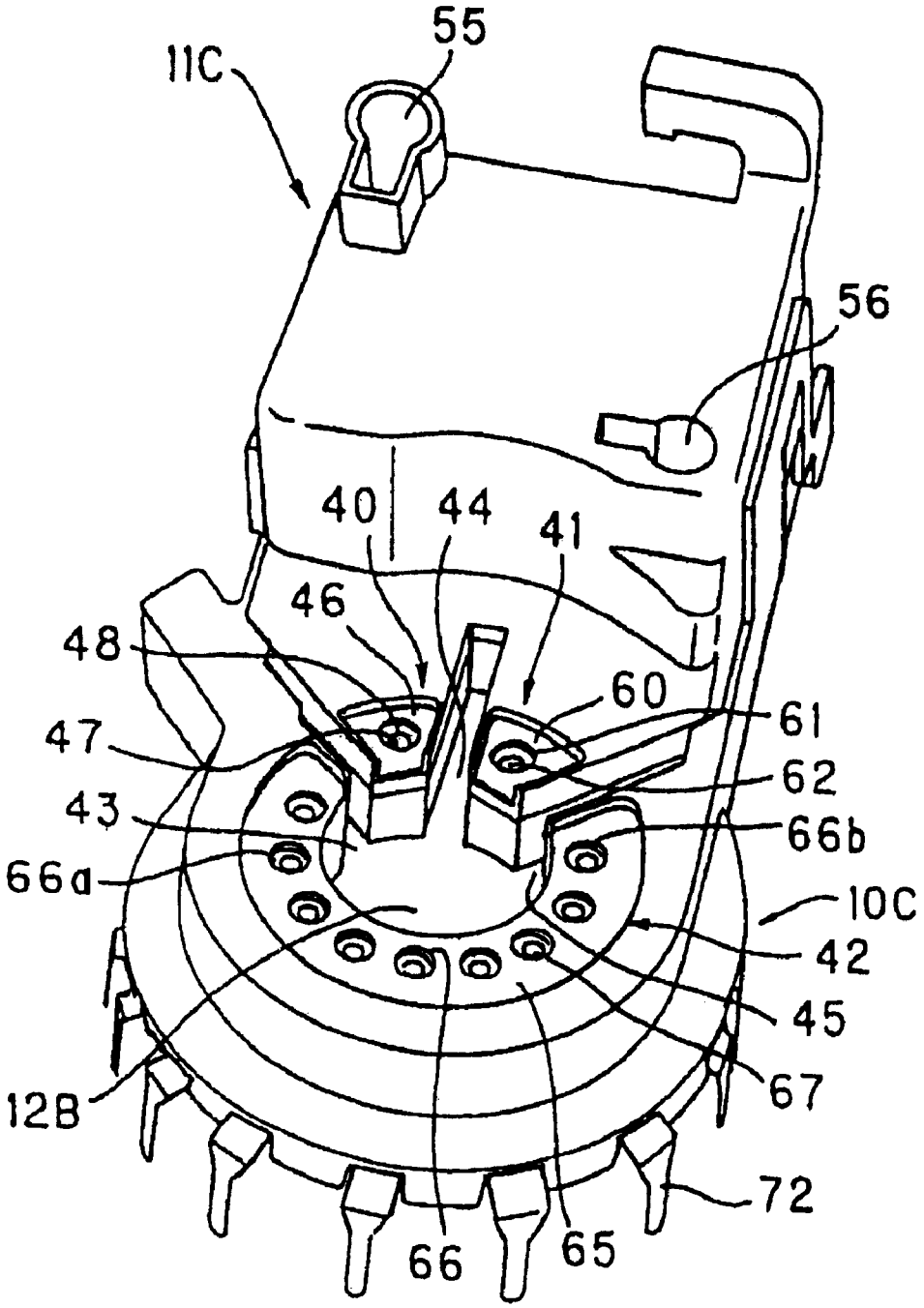
FIG. 1 shows an entire perspective view of a CRT socket according to the present invention.

A CRT socket according to the present invention will next be explained with reference to the accompanying. In this explanation, the same portions as the prior art are designated by the same reference numerals.

As shown in FIGS. 1 through 4, a CRT socket according to the present invention includes a socket body 10C and an insulating cover portion 11C. Socket body 10C engages with a terminal of a neck of a CRT (not shown). Socket body 10C includes a box shaped upper portion to which insulating cover portion 11C is fitted.

A cylindrical central hole 12B is located in a central position of socket body 10C. Cylindrical central hole 12B is formed in a generally cylindrical shape that extends through front and rear faces of socket body 10C. A signal contact recessed portion 42 is formed concentric around cylindrical central hole 12B. Signal contact recessed portion 42 acts as a signal connecting means which engages with a terminal for a signal of the CRT. A high voltage contact recessed portion 40 and a low voltage contact recessed portion 41 are arranged in the insulting cover portion 11C along the same concentric circle as the signal contact recessed portion 42. The high and low voltage contacts serve to engage the focusing terminal of the CRT. High voltage contact recessed portion 40, low voltage contact recessed portion 41, and signal contact recessed portion 42 are physically separated from each other by first, second, and third groove portions 43, 44, and 45. Groove portions 43, 44, and 45 extend through front and rear faces of socket body 10C.

Figure 3:
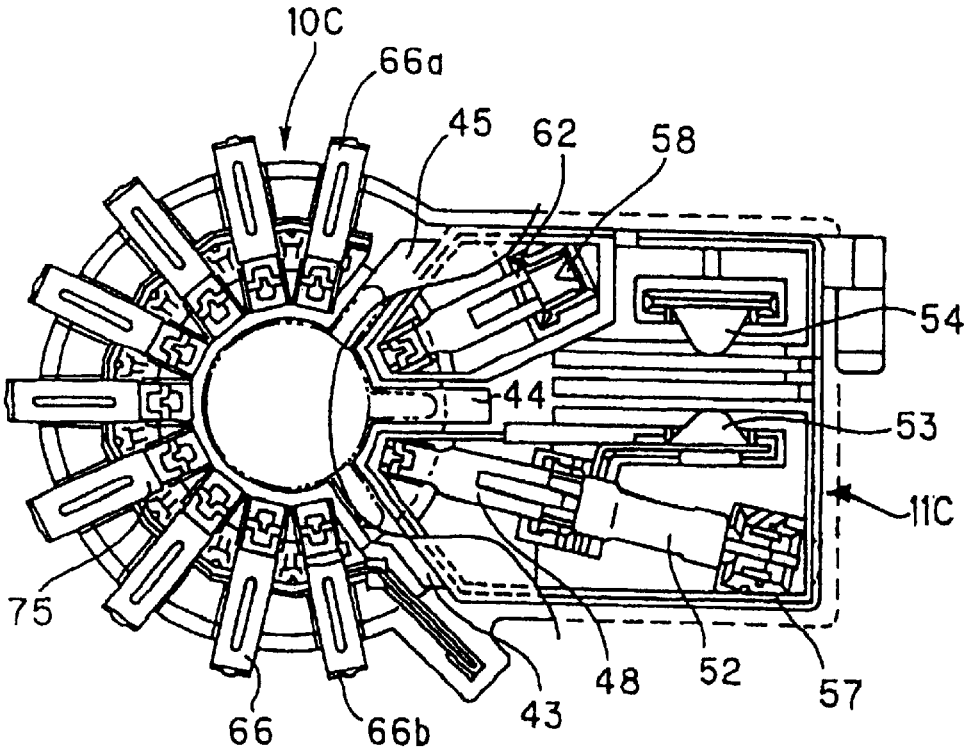
FIG. 3 shows a partially broken rear view of a CRT socket according to the present invention.

A high voltage lead wire nipping portion 55 is arranged in a rear end portion of insulating cover portion 11C. High voltage lead wire nipping portion 55 couples to a high voltage lead wire from a flyback transformer (not shown). A low voltage lead wire nipping portion 56 is arranged in a front end portion of the insulating cover portion 11C. Low voltage lead wire nipping portion 56 couples to a low voltage lead wire from the flyback transformer. Referring now to FIG. 3, terminals 57, 58 are arranged within nipping portions 55, 56.

As shown in FIGS. 1 to 5, high voltage contact recessed portion 40 is separated from other contact portions by first groove portion 43 and second groove portion 44. High voltage contact recessed portion 40 has a recessed face 46 and a high voltage contact hole 47. Recessed face 46 is formed in a fan shaped notch which widens in a direction away from cylindrical central hole 12B, and narrows in a direction towards said cylindrical hole 12B. High voltage contact hole 47 is formed in a portion of recessed face 46 on the side of cylindrical central hole 12B. A high voltage contact (focus contact) 48 is inserted into high voltage contact hole 47 from a rear side of the socket body 10C. High voltage contact 48 is press-fit into engagement with high voltage contact hole 47.

Figure 4:
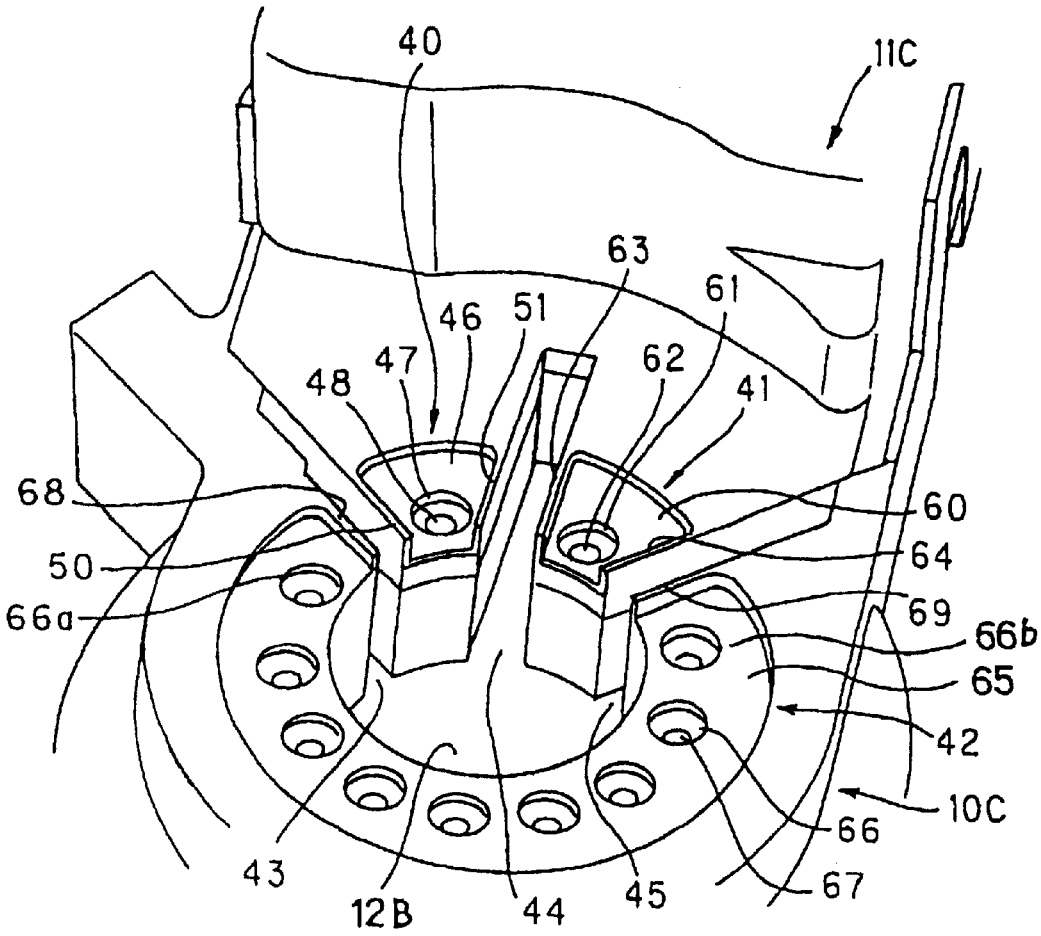
FIG. 4 shows a partially enlarged perspective view of a high voltage contact recessed portion of a CRT socket according to the present invention.
Figure 5:
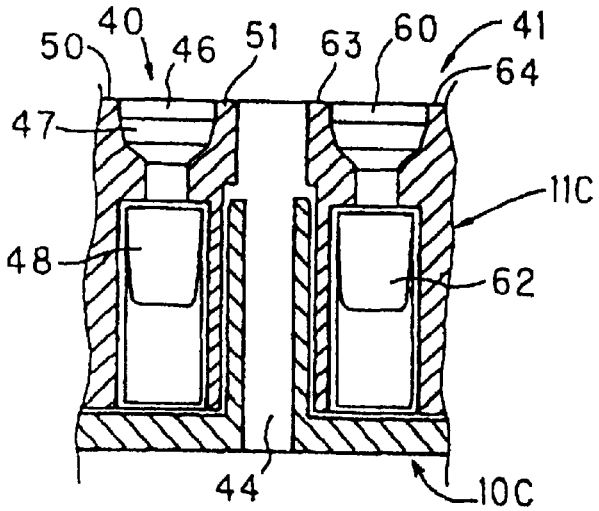
FIG. 5 shows a cross-sectional view, taken along the V—V line depicted in FIG. 2, showing the relative positions of a high voltage contact and a low voltage contact in a CRT socket according to the present invention.

Referring to FIGS. 4 and 5, a partition wall 50 is arranged between recessed face 46 and first groove portion 43. A partition wall 51 is arranged between recessed face 46 and second groove portion 44. A creeping distance for restricting a discharging state of high voltage contact 48 is increased by increasing the heights of partition walls 50 and 51.

Figure 2:
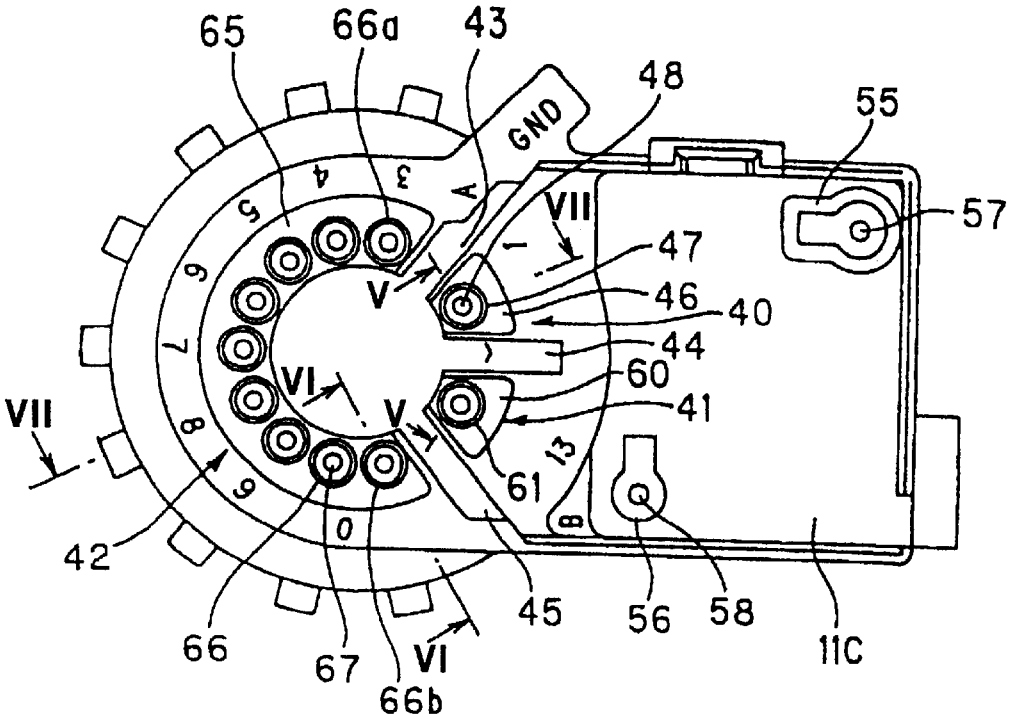
FIG. 2 shows a plan view of a CRT socket according to the present invention.

As shown in FIGS. 2 and 3, high voltage lead wire connecting terminal 57 connects a high voltage lead wire from the flyback transformer (not shown) through a protecting resistance 52 to a high voltage contact 48. High voltage contact 48 is connected to a discharging cap 53 in a position branching from the protecting resistance 52. A discharging cap 54 having a symmetrical shape with respect to discharging cap 53 is arranged at a predetermined distance. Discharging cap 54 has a terminal for discharging electricity to an unillustrated exterior.

Referring now to FIGS. 1 through 5, low voltage contact recessed portion 41 is formed in a symmetrical shape with respect to high voltage contact recessed portion 40. Low voltage contact recessed portion 41 includes a recessed face 60 and low voltage contact hole 61. Low voltage contact recessed portion 41 is separated from other contact portions by second groove portion 44 and third groove portion 45. Recessed face 60 is formed in a fan shaped notch which widens in a direction away from cylindrical central hole 12B, and narrows in a direction towards said cylindrical hole 12B. Low voltage contact hole 61 is formed on a portion of recessed face 60 on the side of cylindrical central hole 12B. Low voltage contact 62 is inserted into low voltage contact hole 61 from the rear side of the socket body 10C. Low voltage contact 62 is press-fit into engagement with low voltage contact hole 61.

Referring to FIGS. 4 and 5, a partition wall 63 is arranged between recessed face 60 and second groove portion 44. A partition wall 64 is arranged between recessed face 60 and third groove portion 44. A creeping distance for restricting a discharging state of low voltage contact 48 is increased by increasing the heights of partition walls 63 and 64.

As shown in FIGS. 2 and 3, low voltage lead wire connecting terminal 58 connects a low voltage lead wire from the flyback transformer (not shown) to low voltage contact 62.

As shown in FIGS. 1, 2, 4, and 5, signal contact recessed portion 42 is located along a concentric circle with respect to the high voltage contact recessed portion 40. Signal contact recessed portion 42 includes a recessed face 65 formed in the shape of a curved surface along cylindrical central hole 12B. A plurality of signal contact holes 66 are uniformly spaced apart from one another, by a predetermined distance, within recessed face 65. A signal contact 67 is inserted into each signal contact hole 66 from the rear side of the socket body 10C. Each signal contact 67 is press-fit into engagement with each respective signal contact hole 66. Signal contact hole 66*a* is physically separated from high voltage contact hole 47 by first groove portion 43. Signal contact hole 66*b* is physically separated from low voltage contact hole 61 by third groove portion 45. Grooved portions 43 and 45 extend through socket body 10C. Extending the height of partition walls 68 and 69 (see FIG. 4) further increases creeping distance.

Figure 6:
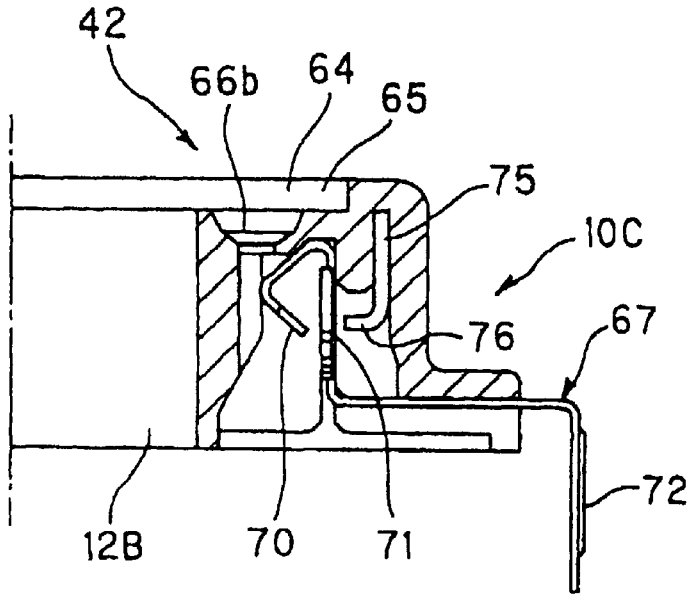
FIG. 6 shows a cross-sectional view, taken along the VI—VI line depicted in FIG. 2, showing a portion of a signal contact in a CRT socket according to the present invention.
Figure 7:
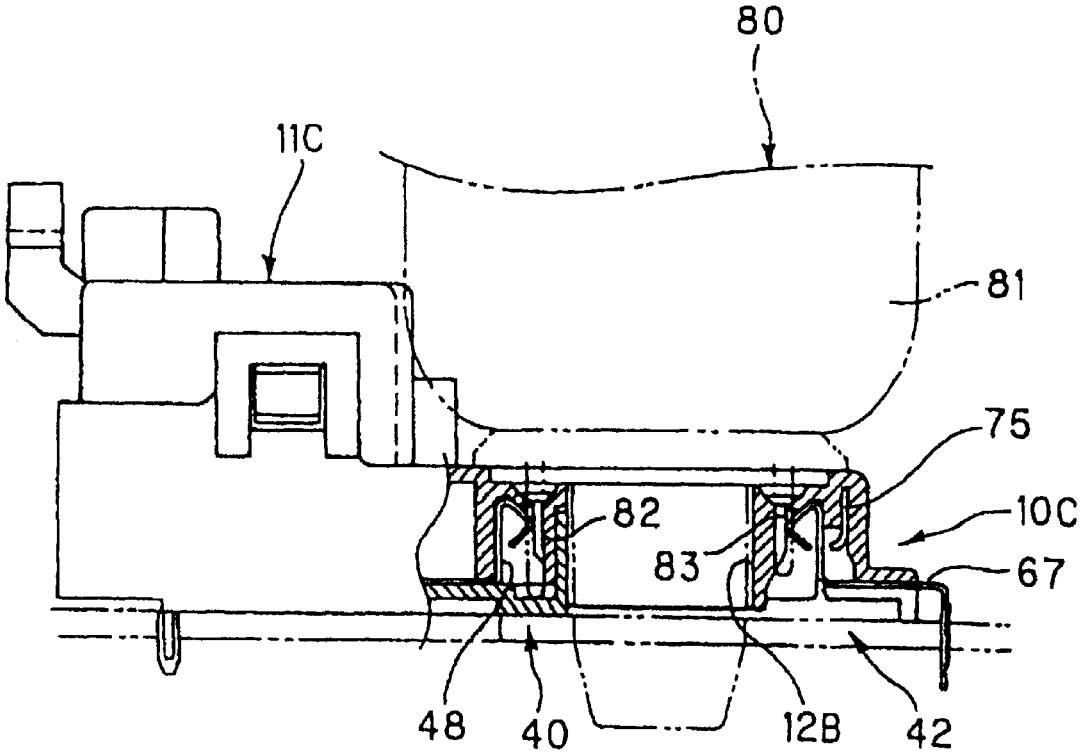
FIG. 7 shows a partially broken sectional view, taken along the VII—VII line depicted in FIG. 2, showing a state in which a terminal of a neck of a CRT is inserted into a CRT socket according to the present invention.
Figure 8:
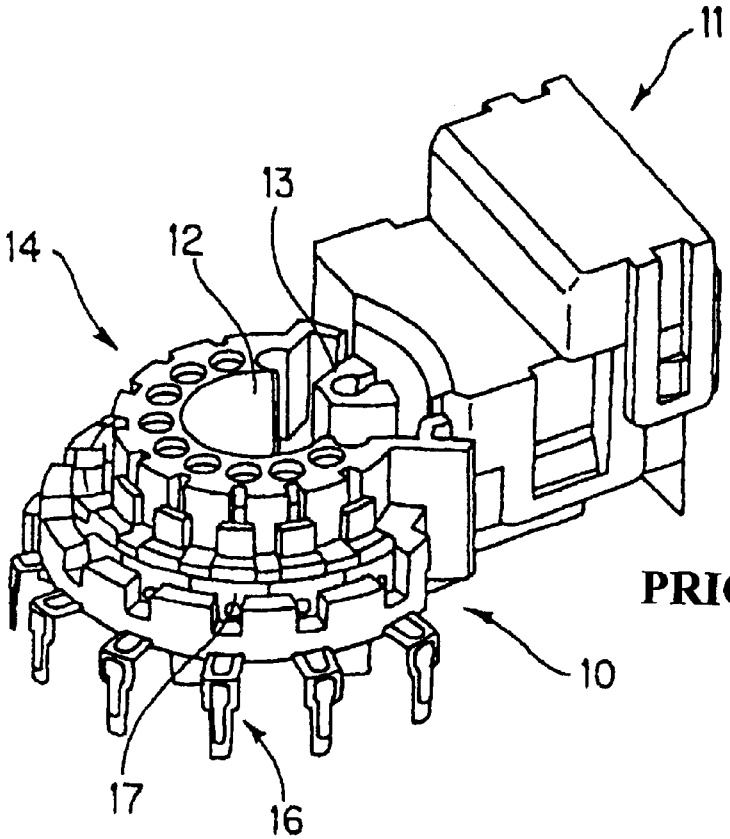
FIG. 8 shows an entire perspective view of a CRT socket according to a first example of the prior art.
Figure 9:
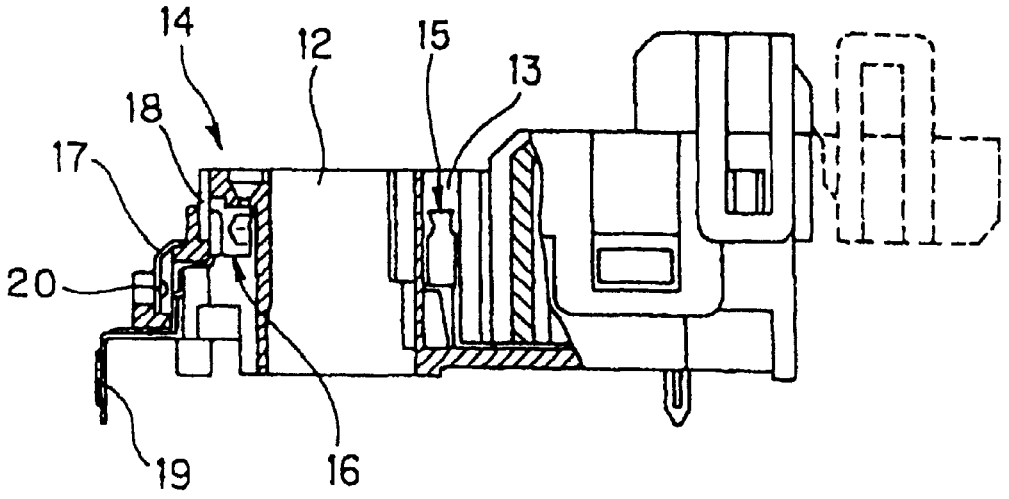
PRIOR ART FIG.9
FIG. 9 shows a cross-sectional view of the prior art CRT socket depicted in FIG. 8, taken along a central longitudinal direction.
Figure 10:
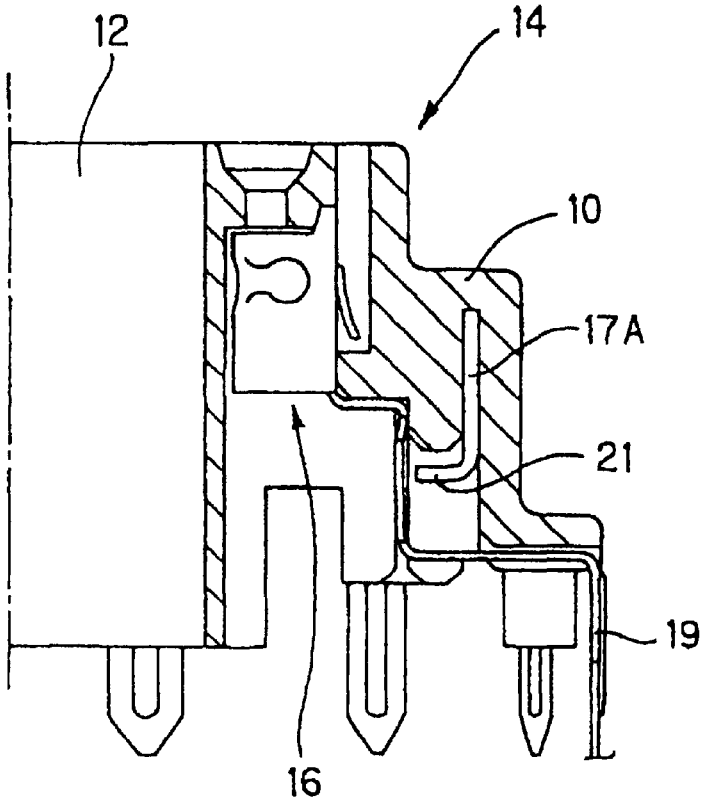
FIG. 10 shows a partially broken sectional view according to a second example of the prior art.
Figure 11:
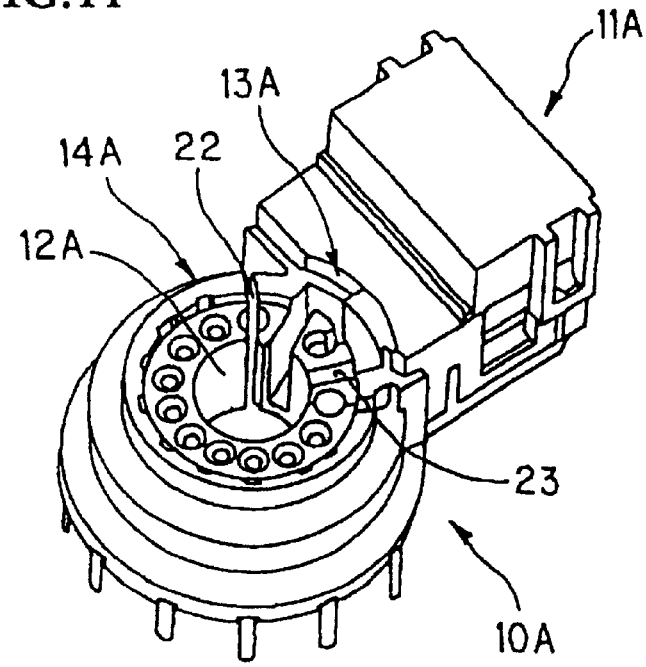
PRIOR ART FIG.11
FIG. 11 shows an entire perspective view of a CRT socket according to a third example of the prior art.
Figure 12:
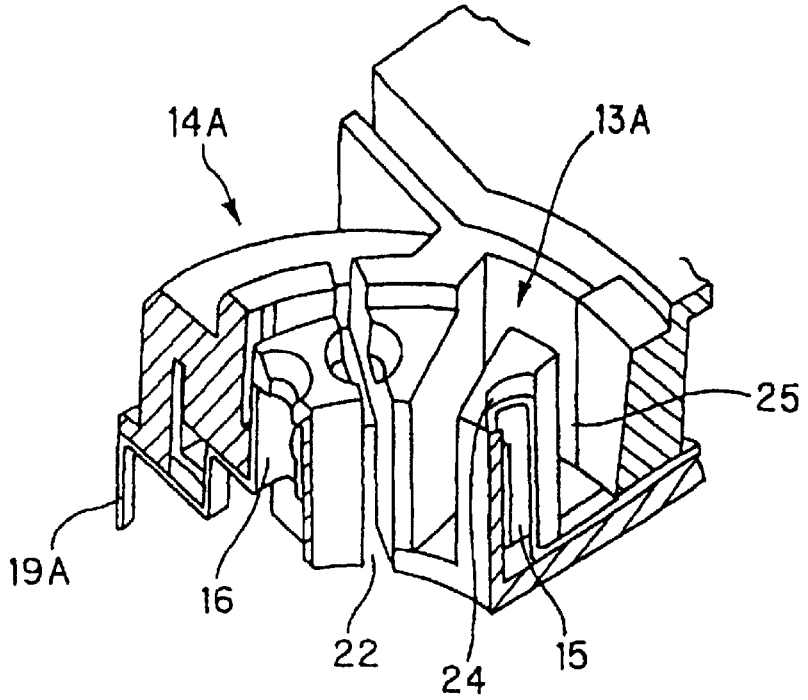
FIG. 12 shows a partially enlarged perspective view of a high voltage contact portion of the prior art CRT socket depicted in FIG. 11.
Figure 13:
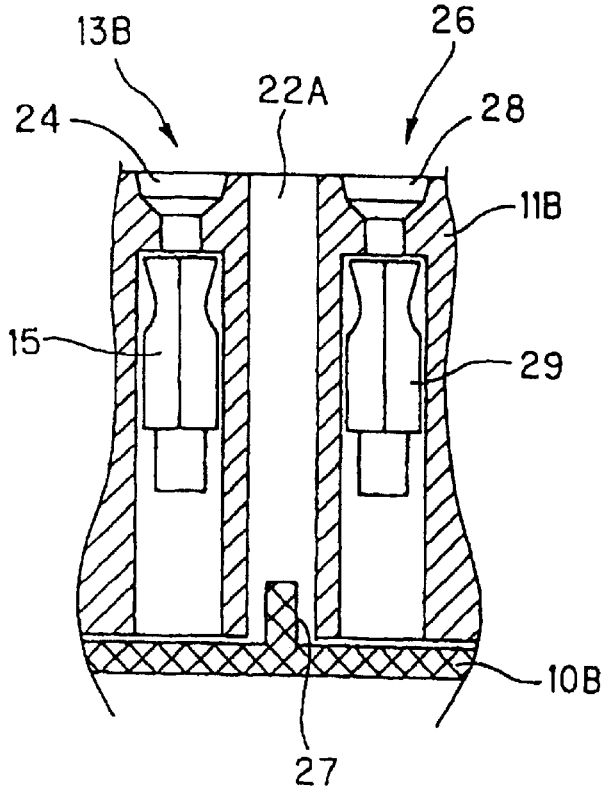
PRIOR ART FIG.13
FIG. 13 shows a partial schematic sectional view of a high voltage contact portion and a low voltage contact portion according to a fourth example of the prior art.

As shown in FIGS. 6 and 7, each signal contact 67 is press-fit and attached to socket body 10C from it's rear side. A contact portion 70 is formed in an L-shape by bending one end tip side of one elongated metallic plate. A discharge plate 71 is formed in a base portion of contact portion 70. A terminal 72, for a signal perpendicularly bent in a direction opposed to contact portion 70, is formed on the other end tip side of the elongated metallic plate. Contact portion 70 of signal contact 67 is arranged in signal contact hole 66 (66*a*, 66*b*) in a state in which one portion of contact portion 70 is exposed.

As shown in FIGS. 3 and 6, a ground terminal 75 is formed as a ring having a notched band shape. Each signal contact 67 has a corresponding ground terminal 75 arranged along an outer circumferential concentric position of contact portion 70.

As shown in FIG. 6, each ground terminal 75 has a tongue portion 76 positioned near discharge plate 71 of signal contact 67. Tongue portion 76 is formed by bending a lower end portion of ground terminal 75 on its inner side. Although not shown in the drawings, it may not br necessary for every signal contact 67 to have a corresponding tongue portion 76. In short, tongue portion 76 is arranged in a signal contact 67 for a signal which requires a discharge. Tongue portion 76 is arranged in a state opposed to discharge plate 71. Namely, tongue portion 76 is arranged in a structure in which discharge plate 71 and ground terminal 75 are arranged in a width direction of socket body 10C. When such a structure is used, it is sufficient to secure a transverse width of socket body 10C in relation to contact portion 70 and ground terminal 75 so that the height of the socket body 10C can be reduced in comparison with the prior art.

A structure including a CRT 80 is shown in FIG. 7. A series of terminals 81 are located along the neck of CRT 80. A focus terminal 82 (terminal for a high voltage), a signal terminal 83 and a low voltage terminal are respectively fit to high voltage contact recessed portion 40, signal contact recessed portion 42 and low voltage contact recessed portion 41. Terminals 82, 83 and the low voltage terminal are electrically coupled to their respective electrical contacts 48, 67 and 62.

As described above, a cathode ray tube socket according to the present invention has a structure in which the signal contact recessed portion and the high voltage contact recessed portion are separated from each other by a groove portion which extends through the socket body. Signal contact holes are formed at predetermined intervals in a recessed portion of a top face of the signal contact recessed portion. A high voltage contact hole is formed in a recessed portion of a top face of the high voltage contact recessed portion. Accordingly, a creeping distance can be increased by increasing the height of a wall formed by the recessed portions so that an influence of discharge can be further avoided.

A signal contact is arranged in each of the signal contact holes in a state in which one portion of a contact terminal coming in contact with a terminal inserted from the exterior is exposed. A ground terminal for removing discharged electricity is arranged in an opposite state to a position behind a contact portion of the exposed signal contact. Accordingly, it is sufficient to secure only a width of the socket body so that the height of the socket body can be correspondingly reduced.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A socket for a cathode ray tube, said cathode ray tube having a plurality of signal terminals and at least one focus terminal, said socket comprising:

a socket body having a cylindrical central hole;

a front face and a rear face on opposing sides of said socket body;

said cylindrical central hole extending through said socket body from said front face to said rear face;

an insulating cover;

a first portion of said insulating cover is arranged on a concentric circle about said cylindrical central hole;

a signal connecting means for engaging said plurality of signal terminals of said cathode ray tube;

a high voltage connecting means for engaging said at least one focus terminal of said cathode ray tube;

said high voltage connecting means and said signal connecting means engaging said cathode ray tube;

said signal connecting means including a signal contact recessed portion and a plurality of signal contact holes;

said signal contact recessed portion is formed in said front face along said concentric circle about said cylindrical hole;

said plurality of signal contact holes are uniformly dispersed at predetermined intervals along said signal contact recessed portion;

said high voltage connecting means having a high voltage contact recessed portion and a high voltage contact hole;

said high voltage contact recessed portion is formed in said front face along said concentric circle about said cylindrical hole;

said high voltage contact hole is formed in said high voltage contact recessed portion of said high voltage connecting means;

a groove portion separating said signal contact recessed portion from said high voltage contact recessed portion; and said groove portion extending through said socket body from said front face to said rear face.

2. A socket for a cathode ray tube as in claim 1 further comprising:

a plurality of signal contact arrangements;

each of said plurality of signal contact arrangements being located within one of said plurality of signal contact holes;

each of said plurality of signal contact arrangements including a signal contact and a ground terminal;

each said signal contact having a first portion which couples to one of said plurality of signal terminals of said cathode ray tube;

each said signal contact having a corresponding discharge plate;

each said ground discharge contact being arranged about said corresponding discharge plate to permit high voltages to discharge from said signal contact to said ground terminal.

3. A socket for a cathode ray tube, said cathode ray tube having a plurality of signal terminals, a high voltage terminal and a low voltage terminal, said socket comprising:

a socket body having a cylindrical central hole;

a front face and a rear face on opposing sides of said socket body;

said cylindrical central hole extending through said socket body from said front face to said rear face;

an insulating cover;

a first portion of said insulating cover is arranged on a concentric circle about said cylindrical central hole;

a signal connecting means for engaging said plurality of signal terminals of said cathode ray tube;

a high voltage connecting means for engaging said at least one focus terminal of said cathode ray tube;

said high voltage connecting means and said signal connecting means engaging said cathode ray tube;

said signal connecting means including a signal contact recessed portion and a plurality of signal contact holes;

said signal contact recessed portion is formed in said front face along said concentric circle about said cylindrical hole;

said plurality of signal contact holes are uniformly dispersed at predetermined intervals along said signal contact recessed portion;

said high voltage connecting means having a high voltage contact recessed portion and a high voltage contact hole;

said high voltage contact recessed portion is formed in said front face along said concentric circle about said cylindrical hole;

said high voltage contact hole is formed in said high voltage contact recessed portion of said high voltage connecting means;

a first groove portion separating said signal contact recessed portion from said high voltage contact recessed portion; and said first groove portion extending through said socket body from said front face to said rear face;

said signal connecting means including a first partition;

said first partition is located between said high voltage connecting means and said signal connecting means; and said first partition is effective to increase a creeping distance between said high voltage connecting means and said signal connecting means.

4. A socket for a cathode ray tube, as in claim 3, wherein said first partition is located at an edge of said signal contact recessed portion adjacent said first groove portion.

5. A socket for a cathode ray tube, as in claim 3, further comprising:

at least a second partition effective to further increase said creeping distance between said high voltage connecting means and said signal connecting means.

6. A socket for a cathode ray tube, as in claim 3, said socket further comprising:

a low voltage connecting means for engaging said low voltage focus terminal of said cathode ray tube;

said low voltage connecting means engaging said cathode ray tube;

said low voltage connecting means having a low voltage contact recessed portion and a low voltage contact hole;

said low voltage contact recessed portion is formed in said front face along said concentric circle about said cylindrical hole;

said low voltage contact hole is formed in said low voltage contact recessed portion of said low voltage connecting means;

a second groove portion separating said high voltage contact recessed portion from said low voltage contact recessed portion; and a third groove portion separating said low voltage contact recessed portion from said signal contact recessed portion.

7. A socket for a cathode ray tube, as in claim 4, said socket further comprising:

said signal connecting means including a second partition; and said second partition is located at an edge of said signal contact recessed portion adjacent said third groove portion.

8. A socket for a cathode ray tube, as in claim 4, said socket further comprising:

said high voltage connecting means including a third partition; and said third partition is located at an edge of said high voltage contact recessed portion adjacent said first groove portion.

9. A socket for a cathode ray tube, as in claim 4, said socket further comprising:

said high voltage connecting means including a fourth partition; and said fourth partition is located at an edge of said high voltage contact recessed portion adjacent said second groove portion.

10. A socket for a cathode ray tube, as in claim 4, said socket further comprising:

said high voltage connecting means including a third partition;

said third partition is located at an edge of said high voltage contact recessed portion adjacent said first groove portion;

said high voltage connecting means including a fourth partition; and said fourth partition is located at an edge of said high voltage contact recessed portion adjacent said second groove portion.

11. A socket for a cathode ray tube, as in claim 8, wherein said third partition and said fourth partition are arranged on opposing sides of said high voltage recessed portion such that said high voltage recessed portion is fan shaped, where said fan widens in a direction radiating outward from said concentric circle.

12. A socket for a cathode ray tube, as in claim 4, said socket further comprising:

said signal connecting means including a second partition;

said second partition is located at an edge of said signal contact recessed portion adjacent said third groove portion;

said high voltage connecting means including a third partition;

said third partition is located at an edge of said high voltage contact recessed portion adjacent said first groove portion;

said high voltage connecting means including a fourth partition; and said fourth partition is located at an edge of said high voltage contact recessed portion adjacent said second groove portion.

13. A socket for a cathode ray tube, as in claim 4, said socket further comprising:

said low voltage connecting means including a fifth partition; and said fifth partition is located at an edge of said low voltage contact recessed portion adjacent said second groove portion.

14. A socket for a cathode ray tube, as in claim 4, said socket further comprising:

said low voltage connecting means including a sixth partition; and said sixth partition is located at an edge of said low voltage contact recessed portion adjacent said third groove portion.

15. A socket for a cathode ray tube, as in claim 4, said socket further comprising:

said low voltage connecting means including a fifth partition;

said fifth partition is located at an edge of said low voltage contact recessed portion adjacent said second groove portion;

said low voltage connecting means including a sixth partition; and said sixth partition is located at an edge of said low voltage contact recessed portion adjacent said third groove portion.

16. A socket for a cathode ray tube, as in claim 13, wherein said fifth partition and said sixth partition are arranged on opposing sides of said low voltage recessed portion such that said low voltage recessed portion is fan shaped, where said fan widens in a direction radiating outward from said concentric circle.

17. A socket for a cathode ray tube, as in claim 4, said socket further comprising:

said signal connecting means including a second partition;

said second partition is located at an edge of said signal contact recessed portion adjacent said third groove portion;

said high voltage connecting means including a third partition;

said third partition is located at an edge of said high voltage contact recessed portion adjacent said first groove portion;

said high voltage connecting means including a fourth partition;

said fourth partition is located at an edge of said high voltage contact recessed portion adjacent said second groove portion;

said low voltage connecting means including a fifth partition;

said fifth partition is located at an edge of said low voltage contact recessed portion adjacent said second groove portion;

said low voltage connecting means including a sixth partition; and said sixth partition is located at an edge of said low voltage contact recessed portion adjacent said third groove portion.

18. A socket for a cathode ray tube, as in claim 8, wherein:

said third partition and said fourth partition are arranged on opposing sides of said high voltage recessed portion such that said high voltage recessed portion is fan shaped, where said fan widens in a direction radiating outward from said concentric circle; and said third partition and said fourth partition are arranged on opposing sides of said high voltage recessed portion such that said high voltage recessed portion is fan shaped, where said fan widens in a direction radiating outward from said concentric circle.

19. A socket for a cathode ray tube, as in claim 3, wherein:

a plurality of signal contact arrangements;

each of said plurality of signal contact arrangements being located within one of said plurality of signal contact holes;

each of said plurality of signal contact arrangements including a signal contact and a ground terminal;

each said signal contact having a contact portion which couples to one of said plurality of signal terminals of said cathode ray tube;

each said signal contact having a corresponding discharge plate;

each said ground discharge contact being arranged about said corresponding discharge plate to permit high voltages to discharge from said signal contact to said ground terminal.

20. A socket for a cathode ray tube, as in claim 17, said socket further comprising:

said socket having an overall socket height;

said overall socket height corresponding to a distance between said front face and said rear face along a first direction;

said first direction being parallel to said cylindrical central hole; and each said ground terminal being an elongated member having upper and lower ends, said upper and lower ends being opposite one another and oriented parallel to said first direction, said lower end having a tongue portion bent towards said corresponding discharge plate such that a discharge gap to formed between said tongue portion and said corresponding discharge plate.

21. A socket for a cathode ray tube, as in claim 17, wherein each said signal contact is an elongated metallic plate having a first end, a second end and a base portion between said first and second end, said contact portion being formed as an L-shaped bent portion at said first end, said discharge plate being formed in said base portion, and a contact terminal formed at said second end extends to an exterior of said socket.

22. A socket for a cathode ray tube, said cathode ray tube having a plurality of signal terminals, a high voltage focus terminal and a low voltage focus terminal, said socket comprising:

a socket body;

a front face and a rear face on opposing sides of said socket body;

a cylindrical central hole extending through said socket body from said front face to said rear face;

an insulating cover;

a first portion of said insulating cover is arranged on a concentric circle about said cylindrical central hole;

a signal connecting means for engaging said plurality of signal terminals of said cathode ray tube;

a high voltage connecting means for engaging said at least one focus terminal of said cathode ray tube;

said high voltage connecting means and said signal connecting means engaging said cathode ray tube;

said signal connecting means including a signal contact recessed portion and a plurality of signal contact holes;

said signal contact recessed portion is formed in said front face along said concentric circle about said cylindrical hole;

said plurality of signal contact holes are uniformly dispersed at predetermined intervals along said signal contact recessed portion;

said high voltage connecting means having a high voltage contact recessed portion and a high voltage contact hole;

said high voltage contact recessed portion is formed in said front face along said concentric circle about said cylindrical hole;

said high voltage contact hole is formed in said high voltage contact recessed portion of said high voltage connecting means;

a first groove portion separating said signal contact recessed portion from said high voltage contact recessed portion; and said first groove portion extending through said socket body from said front face to said rear face;

said signal connecting means including a first partition;

said first partition is located at an edge of said signal contact recessed portion adjacent said first groove portion;

said signal connecting means including a second partition;

said second partition is located at an edge of said signal contact recessed portion adjacent said third groove portion;

said high voltage connecting means including a third partition;

said third partition is located at an edge of said high voltage contact recessed portion adjacent said first groove portion;

said high voltage connecting means including a fourth partition;

said fourth partition is located at an edge of said high voltage contact recessed portion adjacent said second groove portion;

said low voltage connecting means including a fifth partition;

said fifth partition is located at an edge of said low voltage contact recessed portion adjacent said second groove portion;

said first, second, third, fourth, fifth and sixth partitions are effective to increase creeping distance and thereby reduce undesirable high voltage discharges from occurring;

a plurality of signal contact arrangements;

each of said plurality of signal contact arrangements being located within one of said plurality of signal contact holes;

each of said plurality of signal contact arrangements including a signal contact and a ground terminal;

each said signal contact having a contact portion which couples to one of said plurality of signal terminal of said cathode ray tube;

each said signal contact having corresponding discharge plate;

each said ground discharge contact being arranged about said corresponding discharge plate to permit high voltages to discharge from said singal contact to said ground terminal;

said socket having an overall socket height;

said overall socket height corresponding to a distance between said front face and said rear face along a first direction;

said first direction being parallel to said cylindrical central hole;

each said ground terminal being an elongated member, and elongated member having at least one portion arranged such that a discharge gap to formed between said at least one portion arranged such that a discharge gap to formed between said at least one portion and corresponding discharge plate; and said elongated member is formed beneath said front face of said socket body such that said overall socket height is reduced.

23. A socket for a cathode ray tube, as in claim 22, wherein said elongated member of said ground terminal further includes upper and lower ends, said upper and lower ends being opposite one another and oriented parallel to said first direction, and said lower end having a tongue portion bent towards said corresponding discharge plate such that a discharge gap to formed between said tongue portion and said corresponding discharge plate.

24. A socket for a cathode ray tube, as in claim 22, wherein said signal contact is an elongated metallic plate having a first end, a second end and a base portion between said first and second end, said contact portion being formed as an L-shaped bent portion at said first end, said discharge plate being formed in said base portion, and a contact terminal formed at said second end extends to an exterior of said socket.

25. A socket for a cathode ray tube, said cathode ray tube having at least one signal pin, said socket comprising:

a socket body having a cylindrical central hole;

a front face and a rear face on opposing sides of said socket body;

said front face having a top surface and a back surface;

said cylindrical central hole extending through said socket body from said front face to said rear face;

an insulating cover;

a first portion of said insulating cover is arranged on a concentric circle about said cylindrical central hole;

a signal connecting means for engaging said at least one signal pin of said cathode ray tube;

said signal connecting means engaging said cathode ray tube such that said cathode ray tube is substantially in abutment with said top surface of said front face;

said signal connecting means including at least one signal contact, said at least one signal contact being located within said socket body such that a corresponding one of said at least one signal pin of said cathode ray tube extends through said font face of said socket body to engage said at least one signal contact;

said at least one signal contact is an elongated metallic plate having a first end, a second end and a base portion between said first end and second end, said at least one signal contact being formed as an L-shaped bent portion at said first end, a discharge plate being formed in said base portion, and said L-shaped bent portion contacts said corresponding one of said at least one signal pin of said cathode ray tube when engaged; and at least one discharge electrode, said discharge electrode being located opposite said discharge plate effective to form a discharge gap therebetween, and said discharge electrode also being located within said socket body near said back surface such that a height of said socket is reduced.

* * * * *